United States Patent [19]

Williams et al.

[11] Patent Number: 4,646,927

[45] Date of Patent: Mar. 3, 1987

[54] TRANSPORT CONTAINER ASSEMBLY

[76] Inventors: Amy E. Williams; Cole Williams, both of P.O. Box 1084, Glendale, Calif. 91209

[21] Appl. No.: 804,771

[22] Filed: Dec. 5, 1985

[51] Int. Cl.[4] ..... B65D 9/12

[52] U.S. Cl. ..... 217/12 R; 217/36; 217/43 R

[58] Field of Search ..... 217/12 R, 36, 43 R, 217/122; 294/15, 137

[56] References Cited

U.S. PATENT DOCUMENTS

| | | | |
|---|---|---|---|
| 573,718 | 12/1896 | Stratton | 217/43 |
| 938,887 | 11/1909 | Neebes, Jr. | 217/12 R |
| 1,956,768 | 5/1934 | Kubes | 217/36 |
| 2,615,589 | 10/1952 | Perdue | 217/12 R |
| 3,143,236 | 8/1964 | Haas | 217/12 R |
| 3,204,803 | 9/1965 | Sandkuhle | 217/12 R |
| 3,375,793 | 4/1968 | Wagner | 217/43 A |
| 3,557,990 | 1/1971 | Lipiros | 217/43 R |

*Primary Examiner*—Steven M. Pollard
*Attorney, Agent, or Firm*—James E. Brunton

[57] ABSTRACT

An erectable transport container comprising end members, slats and handle which are compactly packagable in a disassembled kit form for later assembly without the need for tools, separate fasteners, or adhesive to form a useful container for storage, transport or decoration. A locking mechanism is provided to prevent accidental disassembly of the container after it has been assembled.

10 Claims, 3 Drawing Figures

FIG. 1
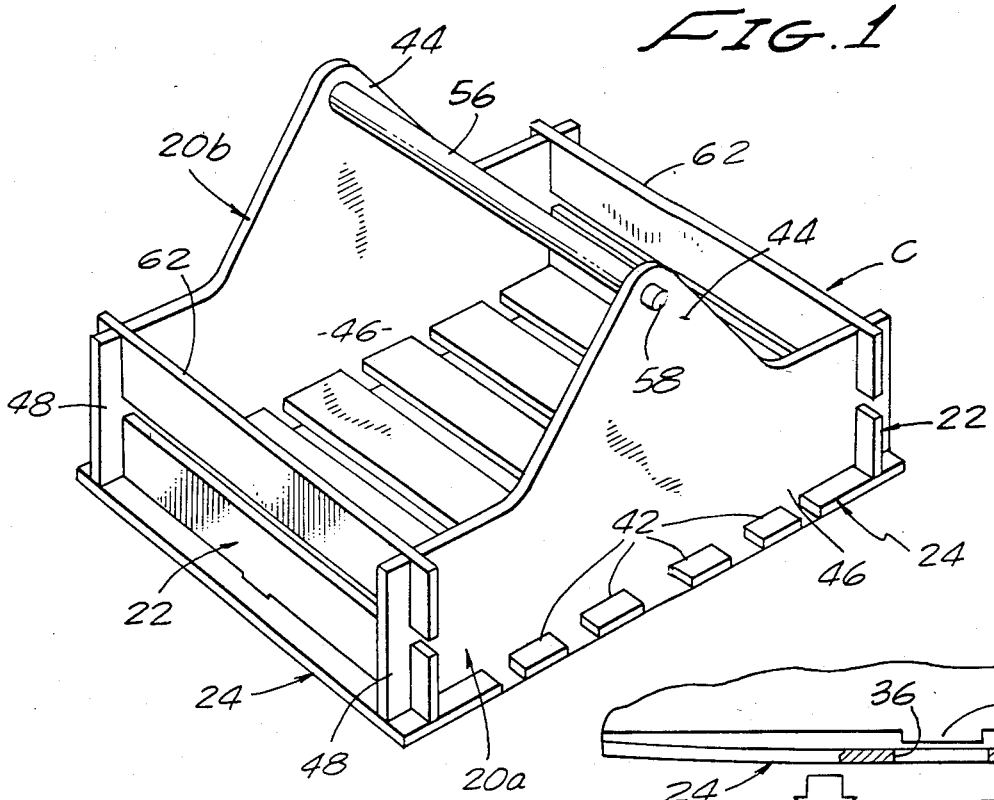
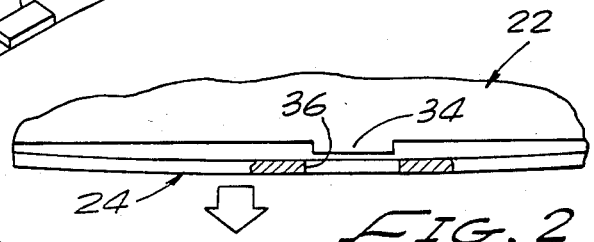
FIG. 2
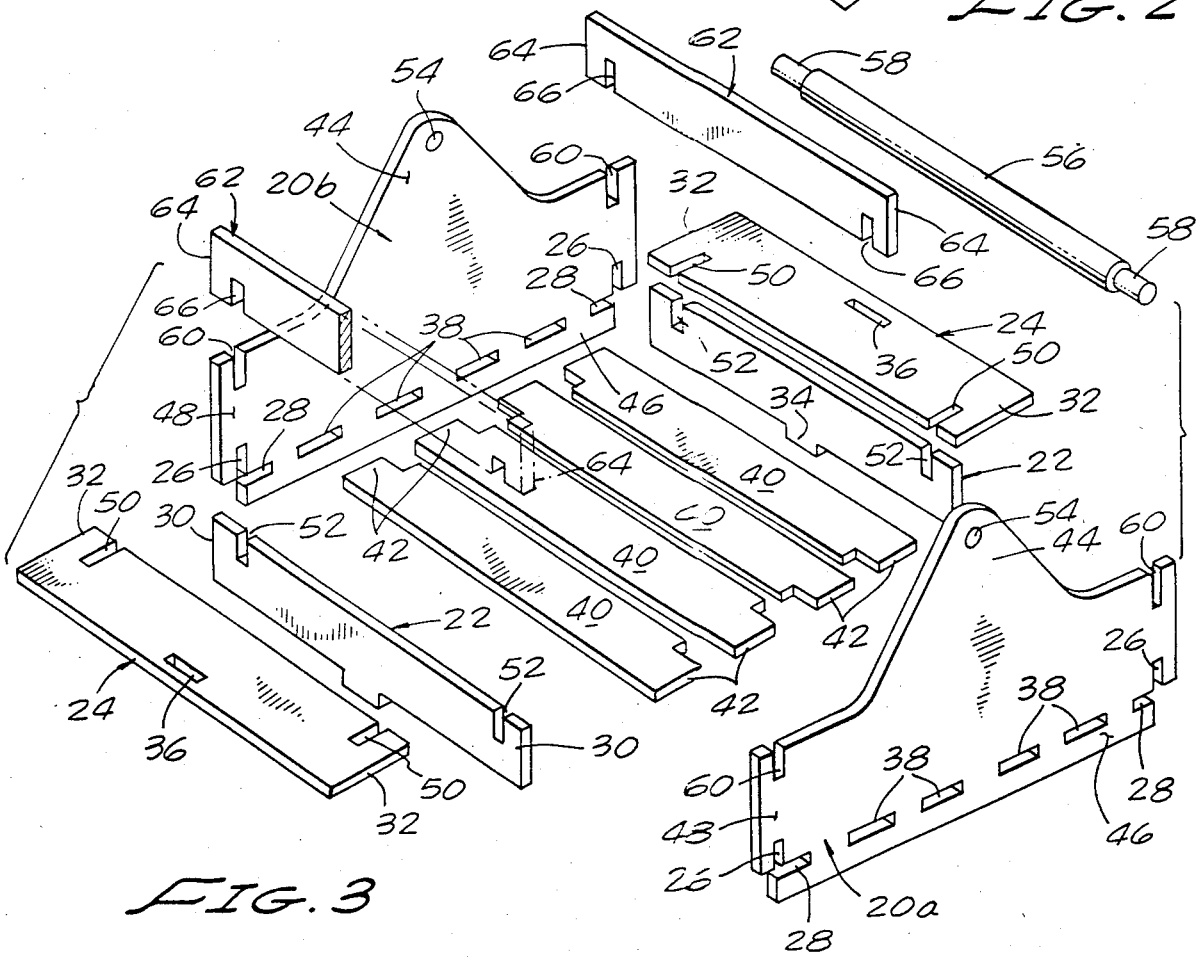
FIG. 3

TRANSPORT CONTAINER ASSEMBLY

BACKGROUND OF THE INVENTION

1. Field of the Invention

The present invention relates generally to transport containers. Specifically the apparatus of the present invention provides an erectable transport container comprising end members, slats, and handle which are compactly packagable and may be assembled without tools, separate fasteners, or adhesive to form a useful container for storage, transport, or decoration.

2. Discussion of the Prior Art

Transport containers similar to the present invention are typically fabricated from wood or cardboard. The wooden containers are assembled with nails or adhesive to form a rigid box. The typical orange crate is exemplary of this type of container. The wooden container of this type is a strong durable container, however, fasteners such as nails or adhesive must be employed to construct the container and the container cannot be easily disassembled or reassembled.

The cardboard container is typically fabricated using interleaved cardboard flaps to maintain the structural integrity of the container. In some cases adhesive is used to further strengthen the container which prevents easy disassembly of the container or may preclude disassembly of the container without destruction. Tape may also be used to add structural integrity to the container or prevent its unplanned disassembly, however, this again prevents easy disassembly of the container and may cause damage to the container during disassembly.

SUMMARY OF THE INVENTION

The present invention provides a transport container which may be packaged, shipped, or stored in the unassembled condition. The individual pieces of the apparatus are compact for efficiency in this role. The apparatus comprises two end members and slats which extend from one end member to the other forming the desired enclosure, and a handle extending from one end member to the other.

Unlike the orange crate or similar wooden container, the present invention does not require nails, adhesive, or other fasteners for assembly. The end members of the apparatus contain apertures and slots which receive the slats and handle. A locking means is provided for releasably interlocking key slats together to prevent accidental disassembly of the container. Also unlike the orange crate, the present invention may be disassembled by releasing the locking means on the slats and removing the slats from the end members. The container of the invention may be assembled and disassembled numerous times without damage or degradation.

The present invention is superior to cardboard containers. The invention provides a container which is more rigid than comparable cardboard containers and may be assembled without adhesives or tape. The invention may also be disassembled and reassembled without damage, bending, or tearing which plague most cardboard containers in similar service.

It is an object of the invention to provide a transport container assembly which may be compactly packaged, stored, and shipped in the unassembled condition.

It is another object of the invention to provide a transport container assembly which may be easily assembled without special tools, adhesives, or other fasteners.

It is yet another object of the invention to provide a transport container as previously described which may be easily disassembled without damage when not in use and easily reassembled.

BRIEF DESCRIPTION OF THE DRAWINGS

FIG. 1 is a pictorial view of the assembled transport container.

FIG. 2 is a fragmentary cutaway of the locking tab and receiving aperture.

FIG. 3 is an exploded view of the transport container assembly showing individual elements of the apparatus and slots and apertures therein.

DETAILED DESCRIPTION OF THE INVENTION

Referring to the drawings, one form of the invention is there shown. FIG. 1 shows the transport container assembly C in the assembled condition. Referring particularly to FIG. 3, an exploded view of the invention shows this embodiment to comprise two end members 20*a* and 20*b*, first or side slats 22 and second or bottom slats 24. The end members 20*a* and 20*b* have first slots 26 and second slots 28 disposed proximate the periphery of the end members. The first or side slats 22 have slotted end portions 30 adapted for interengagement with the first slots 26 in the end members 20*a* and 20*b*. The second or bottom slats 24 also have slotted end portions 32 adapted for interengagement with the second slots 28 in the end members 20*a* and 20*b*.

A locking means, to be presently described, is provided for releasably interlocking together the first or side slats 22 and the second or bottom slats 24 when the first and second slats are in engagement with the first and second slots 26 and 28.

The locking means for the embodiment of the invention shown in the drawings is best seen in FIGS. 2 and 3. The locking means comprises an outwardly extending tab 34 formed on each of the first or side slats 22. The tab 34 is adapted to be received in apertures 36 formed in each of the second or bottom slats 24.

In the form of the invention shown, each of the end members 20*a* and 20*b* is provided with a plurality of spaced apertures 38 disposed intermediate the first slots 26. A plurality of intermediate or second bottom slats 40 having end portions 42 adapted to be received in said spaced apertures 38 are provided.

The end members 20*a* and 20*b*, in the embodiment shown in the drawings, have top 44, bottom 46, and side 48 portions. The first slots 26 are disposed proximate each side portion 48 and the second slots 28 are disposed proximate the bottom portion 46. The two bottom slats 24 have slots 50 formed proximate each end portion 32 thereof for interengagement with the second slots 28 formed proximate the bottom portion 46 of the end members 20*a* and 20*b*.

The two side slats 22 have slots 52 formed proximate the end portions 30 thereof for interengagement with the first slots 26 formed proximate the side portions 48 of the end members 20*a* and 20*b*.

The locking means comprising the tab 34 on the side slats 22 and the aperture 36 in the bottom slats 24 provides for interlocking the side and bottom slats together to prevent their disengagement from the first and second slots 26 and 28 in the end members 20*a* and 20*b*.

As shown in the drawings, each of the end members 20*a* and 20*b* is provided with a first aperture 54 disposed proximate the top portion 44 thereof. The form of the invention shown further includes a handle 56 having reduced diameter end portions 58 closely receivable within the apertures 54.

In this embodiment of the invention the locking aperture 36 is formed intermediate the end portions 32 of each of the bottom slats 24. The locking tab 34 extends from each of the side slats 22. The tab 34 is closely receivable within the locking apertures 36 when the bottom slats 24 are interengaged within the slots 28 formed proximate the bottom portion 46 of the end members 20*a* and 20*b* and the side slats 22 are interengaged within the slots 26 formed proximate the side portions 48 of the end members.

The end members 20*a* and 20*b* may have one or more second apertures 38 formed proximate the bottom portion 46 thereof. The container C further comprises at least one second bottom slat 40 having end portions 42 closely receivable into the second apertures 38.

As shown in FIGS. 1 and 3 the transport container assembly C may have third slots 60 formed proximate the side portions 48 of the end members 20*a* and 20*b* distal the bottom portion 46. The container C further then further comprises two second side slats 62 having end portions 64. Each second side slat 62 has a slot 66 formed proximate each end portion 64 thereof for interengagement with the third slots 60 in the end members 20*a* and 20*b*.

Other embodiments of the invention could include intermediate apertures spaced between the first slots 26 and third slots 60 and intermediate side slats with ends adapted to be received within these apertures.

The embodiment shown in the drawings has two end members 20*a* and 20*b* having top 44, bottom 46, and side 48 portions. Each end member has two slots 26 and 60 formed proximate the side portions 48. One of the slots, slot 26, intersects a slot 28 proximate the bottom portion 46 of each end member 20*a* and 20*b*. Each end member 20*a* and 20*b* further has at least two apertures 38 formed proximate the bottom portion 46 and each end member has an aperture 54 formed proximate the top portion 44 thereof.

As shown in the drawings for this embodiment of the invention, the top portion 44 of the end members 20*a* and 20*b* is substantially triangular in shape. and the side and bottom portions 48 and 46 are substantially rectangular in shape. Other embodiments of the invention could use circular, oval, rhomboidal, or other shaped end members with slots and apertures spaced about the periphery. The slots and slats of the container may be arranged to provide total enclosure.

The invention may be fabricated from plywood, plastic, or other suitable material and may be sized appropriately for the desired use.

Assembly of the invention is accomplished by inserting the end portions 42 of the intermediate slats 40 into the apertures 38 in the end members 20*a* and 20*b*, interengaging the slots 52 of the side slats 22 with the slots 26 in the end members, interengaging the slots 66 of the second side slats 62 with the slots 60 in the end members, interengaging the slots 50 of the bottom slats 24 with the slots 28 of the end members and flexing the bottom slats 24 to clear the locking tab 34 on the side slats 22, then relaxing the bottom slats 24 to allow the tab 34 to be received in the aperture 36 in the bottom slats 24 as shown in FIG. 2. This locks the assembly and prevents inadvertant disassembly. The handle 56 is then added by flexing the top portions 44 of the end members 20*a* and 20*b* and aligning the end portions 58 of the handle 56 with the apertures 54 in the top portions. Relaxing the top portions 44 then allows the end portions 58 of the handle 56 to be received in the apertures 54 completing the assembly.

Disassembly of the container is accomplished by flexing the bottom slats 24 to disengage the tab 34 from the aperture 36 and removing the bottom slats 24. The side slats 22 and 62 may then be removed and the handle 56 and intermediate slats 40 removed from the end members 20*a* and 20*b* completing disassembly.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A transport container assembly comprising:

(a) two end members, each member having first and second perpendicularly intersecting slots disposed proximate the periphery of said members;

(b) at least one first slat having end portions, each of said first slats having a slot formed proximate each end portion thereof for interengagement with said first slots in said end members;

(c) at least one second slat having end portions, each of said second slats having a slot formed proximate each end portion thereof for interengagement with said second slots in said end members; and, (c) locking means for releasably interlocking together said first and second slats when said first and second slats are in engagement with said first and second slots.

2. A transport container as defined in claim 1 in which said locking means comprises an outwardly extending tab formed on each of said first slats adapted to be received in apertures formed in each of said second slats.

3. A transport container as defined in claim 1 in which each of said end members is provided with a plurality of spaced apertures disposed intermediate said first slots and in which said transport container assembly further comprises a plurality of intermediate slats having end portions adapted to be received in said apertures.

4. A transport container assembly comprising:

(a) two end members, each member having top, bottom and side portions, each said member further having a first slot disposed proximate each side portion intersecting a second slot formed proximate said bottom portion;

(b) two bottom slats having end portions, each said bottom slat having a slot formed proximate each end portion thereof for interengagement with said second slots formed proximate said bottom portion of said end members;

(c) two side slats having end portions, each said side slat having a slot formed proximate each end portion thereof for interengagement with said first slots formed proximate said side portions of said end members; and, (d) locking means for interlocking said side slats and said bottom slats together to prevent their disengagement from said first and second slots in said end member.

5. A transport container assembly as defined in claim 4 in which each of said end members is provided with a first aperture disposed proximate said top portion thereof and in which said assembly further includes a handle member having end portions closely receivable within said aperture.

6. A transport container assembly as defined in claim 5 in which said locking means comprises:

(a) a locking aperture formed intermediate the end portions of each of said bottom slats; and, (b) a locking tab extending from each of said side slats, said locking tab being closely receivable within said locking apertures in said bottom slats when said bottom slats are interengaged within said slots formed proximate said bottom portion of said end members and said side slats are interengaged within said slots formed proximate said side portions of said end members.

7. A transport container assembly as defined in claim 5 in which said end members each have at least one second aperture formed proximate said bottom portion thereof and said container further comprises at least one second bottom slat having end portions closely receivable into said second apertures in said end members.

8. A transport container assembly as defined in claim 7 in which said end members have third slots formed proximate said side portions distal said bottom portion and said container further comprises two second side slats having end portions, each said second side slat having a slot formed proximate each end portion thereof for interengagement with said third slots formed proximate said side portions of said end members.

9. A transport container assembly comprising:

(a) two end members, each member having top, bottom and side portions and having two slots formed proximate said side portions, one of said slots intersecting a slot formed proximate said bottom portion, each said member further having at least two apertures formed proximate said bottom portion and each said member having an aperture formed proximate said top portion thereof;

(b) two first bottom slats having end portions, each said first bottom slat having a slot formed proximate each end portion thereof for interengagement with said slots formed proximate said bottom portion of said end members, each said second bottom slat having a locking aperture formed intermediate the end portions thereof;

(c) at least two second bottom slats each having end portions closely receivable into said apertures formed proximate said bottom portions of said end members;

(d) two first side slats having end portions, each said first side slat having a slot formed proximate each end portion thereof for interengagement with said one of said slots formed proximate said side portions of said end members which intersects said slot formed proximate said bottom portion, each said first side slat having a locking tab closely receivable within said locking apertures in said first bottom slats when said first bottom slats are interengaged with said slots formed proximate said bottom portion of said end members;

(e) two second side slats having end portions, each said second side slat having a slot formed proximate each end portion thereof for interengagement with said slots formed proximate said side portions distal said bottom portion of said end members; and, (f) a handle member having end portions closely receivable within said apertures proximate said top portions of said end members.

10. A transport container assembly as defined in claim 9 wherein said top portion of said end members is substantially triangular in shape and said side and bottom portions are substantially rectangular in shape.

* * * * *